US006234943B1

(12) United States Patent
Copin

(10) Patent No.: US 6,234,943 B1
(45) Date of Patent: May 22, 2001

(54) PROCESS AND DEVICE FOR PREPARING A PACKAGING BLANK AND PACKAGING PREPARED BY SUCH BLANK

(75) Inventor: Maurice Copin, Cortaillod (CH)

(73) Assignee: Philip Morris Incorporated, New York, NY (US)

( * ) Notice: Subject to any disclaimer, the term of this patent is extended or adjusted under 35 U.S.C. 154(b) by 0 days.

(21) Appl. No.: 08/946,425

(22) Filed: Oct. 7, 1997

(51) Int. Cl.[7] ..... B31B 1/10; B31B 1/14; B31B 1/74; B26D 7/26

(52) U.S. Cl. ..... 493/11; 53/51; 53/133.8; 493/22; 493/363

(58) Field of Search ..... 53/51, 133.6, 133.8; 493/11, 22, 66, 61, 363, 936, 63

(56) References Cited

U.S. PATENT DOCUMENTS

| | | | | |
|---|---|---|---|---|
| 3,577,834 | * | 5/1971 | Lang | 493/61 X |
| 3,981,213 | | 9/1976 | Lopman | 83/346 |
| 4,464,154 | * | 8/1984 | Ljungcrantz | 493/963 X |
| 4,586,312 | | 5/1986 | Limousin | 53/412 |
| 4,715,847 | * | 12/1987 | Focke et al. | 493/11 |
| 5,078,273 | * | 1/1992 | Kuchenbecker | 493/63 X |
| 5,292,299 | * | 3/1994 | Anderson et al. | 493/11 |
| 5,319,910 | * | 6/1994 | Takata et al. | 493/61 X |
| 5,429,577 | | 7/1995 | Simpson et al. | 493/354 |
| 5,447,486 | | 9/1995 | Anderson et al. | 493/11 |
| 5,464,148 | | 11/1995 | Schoch et al. | 229/109 |

FOREIGN PATENT DOCUMENTS

| | | |
|---|---|---|
| 425903 | 10/1990 | (EP) . |
| 693424 | 1/1996 | (EP) . |
| 2087292 | 12/1971 | (FR) . |
| 2261199 | 2/1974 | (FR) . |
| 06166125 | 11/1992 | (JP) . |

OTHER PUBLICATIONS

PCT/CH97/00374 (Search Report), Dec. 22, 1997.
EP 96810674.0 (Search Report), Apr. 1, 1997.

* cited by examiner

*Primary Examiner*—James F. Coan
(74) *Attorney, Agent, or Firm*—Clinton H. Hallman, Jr.; Kevin B. Osborne; Charles E. B. Glenn

(57) ABSTRACT

Packaging, particularly for a carton of cigarette packs, includes opening structure permitting easy access to one or more of the objects or packs of cigarettes which it contains. The opening structure includes a line of pre-weakened resistance, comprising pre-cuts, either passing completely through the material constituting the packaging or incompletely through the thickness of that material. Individual pre-cuts may be separated by interconnected attachment portions. The line of weakened resistance may partially or completely surround a surface disposed on one, two, or three faces of the packaging. Structure for starting the opening may be provided. A process and a device permitting such packaging are also disclosed.

35 Claims, 7 Drawing Sheets

PROCESS AND DEVICE FOR PREPARING A PACKAGING BLANK AND PACKAGING PREPARED BY SUCH BLANK

BACKGROUND OF THE INVENTION

A. Field of the Invention

The present invention relates to packaging, and particularly to packaging cartons of cigarettes as well as their manufacturing processes and devices.

The finished packs of cigarettes, generally containing twenty cigarettes, are normally regrouped in cartons generally containing ten packs disposed in two superimposed rows of five packs each. Independent of the specific make-up of the packaging of each pack, whether it be a soft or rigid pack, the carton itself may be of a soft type or of a rigid type according to the material chosen.

B. Description of the Prior Art

The prior art soft-type cartons are generally made of a packaging of a flexible and opaque material such as paper, metallized paper or a composite material. Hard cartons are generally formed of a stiff cardboard.

For the soft cartons, called "bundles", a tearing tab, connected to the end of a tearing thread or tape, is generally provided on a face or an edge of the carton, the tearing thread or tape going around the carton, i.e., entirely separating the carton into two portions at the time of its opening. The two portions can be six packs (two deep and three long) by four packs (two deep and two long) and even eight packs by two packs.

The consumer wishing to remove a pack from the carton, having therefore opened a carton containing ten packs of cigarettes, will generally find a first carton portion containing six packs in one hand and a second portion containing four packs in the other hand. According to the location where the tearing thread or tape is disposed, there may be a first portion of eight packs and a second portion of two packs. However, it has been hitherto impossible to obtain exactly one single pack on the first opening.

The consumer will finally obtain a single pack of cigarettes by breaking one of the portions, so that he is left with two carton portions, one of which is opened.

Another potential drawback of a carton according to the prior art is the presence of the tearing thread or tape, i.e., of a material different from that of the packaging, which it is necessary to add to it at the time of making the latter.

OBJECTS OF THE INVENTION

A first object of the present invention is a process for manufacturing packaging, particularly a carton of cigarettes, which permits the user to remove a single pack easily and directly, while retaining a packaging, i.e., a carton, in one single portion.

Another object of the invention is a device which permits the preceding process to be carried out.

Still another object of the invention is a packaging, particularly a carton of cigarettes, having an opening therein which permits the user to remove a single pack easily and directly, while retaining the packaging, i.e., a carton, in one single portion.

And yet another object of the present invention is to form a structure which permits the opening of the preceding packaging to be started easily, without the necessity of adding a supplementary packaging component to it.

SUMMARY OF THE INVENTION

In accordance with the present invention, a process of preparing opening structure on a packaging blank includes the step of producing a line of weakened resistance at the opening structure with a pre-cutting roller or die. The device for preparing the opening structure generally comprises a rotating pre-cutting roller or die that presses on a web of material constituting the packaging blank as the web moves in a longitudinal direction.

The packaging produced by these processes and devices has a pre-cut opening which permits access to one or more of the objects contained in the packaging. The opening structure is on a surface portion of the packaging partially or totally surrounded by the line of weakened resistance. A drive roller with a flattened face is provided for briefly pausing the web for operations to be performed thereupon.

BRIEF DESCRIPTION OF THE PATENT DRAWINGS

Novel features and advantages of the present invention in addition to those mentioned above will become apparent to persons of ordinary skill in the art from a reading of the following detailed description in conjunction with the accompanying drawing wherein:

FIGS. 1A, 1B, 1C, and 1D illustrate four embodiments for opening a carton of cigarettes, according to the invention;

FIGS. 2A, 2B, 2C, and 2D illustrate four exemplary embodiments for starting the opening of a carton, according to the invention;

DETAILED DESCRIPTION OF THE INVENTION

Figure 1A:
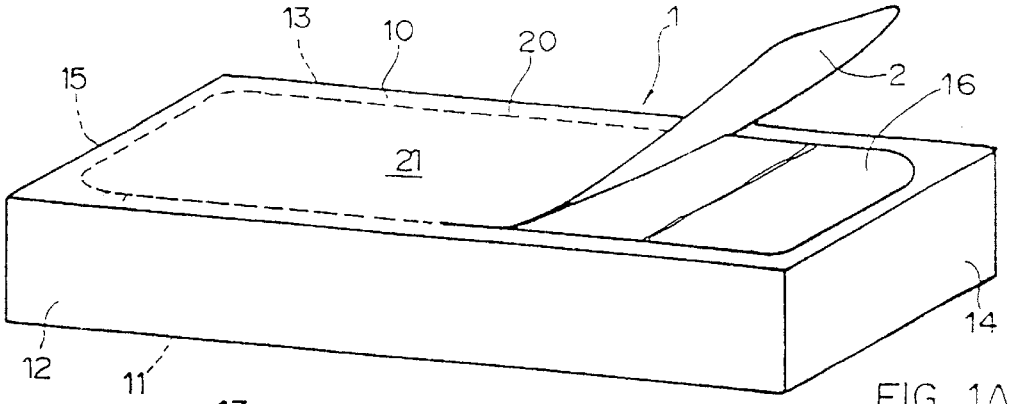

Referring to the drawings, each of the cartons of cigarettes 1 shown in FIGS. 1A, 1B, 1C, and 1D has a top face 10, a bottom face 11, two side faces 12, 13, and two opposed end faces 14, 15. Together these faces form a right parallelepiped. Normally, carton 1 includes ten packs of cigarettes 16 grouped in two superimposed rows of five packs each.

The carton 1 of the invention further includes opening structure 2 made of a portion of at least one of the faces of the carton. The opening structure 2 is easily removed from the carton face pre-cut line 20. By easily, it is meant that light pressure from fingers or fingernails may act to separate the pre-cut lines by pinching, scratching or scraping, and no punch-through to start a tear is required.

In the embodiment of the invention shown in FIG. 1A, the pre-cut line 20 has a generally rectangular configuration with the corners formed as portions of a circle. More particularly, the pre-cutout surface portion 21 has dimensions such that its length and its width are slightly less than the corresponding dimensions of the top face 10. Opening only a portion of the pre-cutout portion 21 permits a pack of cigarettes to be removed easily and directly, whereas if the entire portion 21 is removed, all the packs situated directly beneath the top face 10 are accessible. In either case of partial or complete removal of the surface portion 21, the packs 16 remain lightly held within the carton by the residual peripheral portions of the top face 10.

Figure 1B:
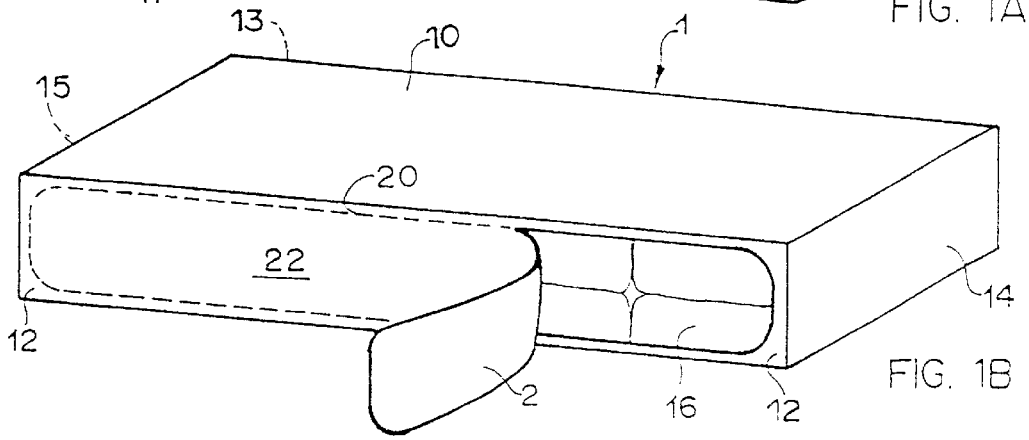

Another embodiment of the opening structure 2 is shown in FIG. 1B, where the portion 22 is pre-cut on one of the side faces 12.

Figure 1C:
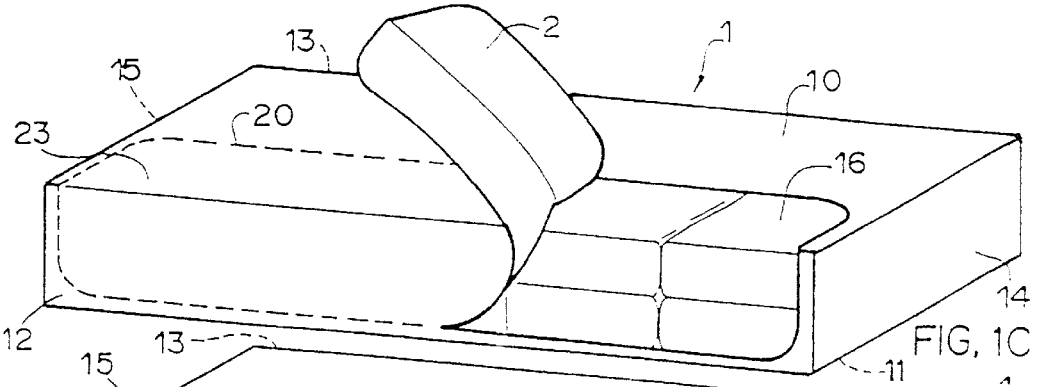

FIG. 1C shows the third embodiment where two interconnected surface portions 23 extend over a portion of the top and side faces 10, 12.

Figure 1D:
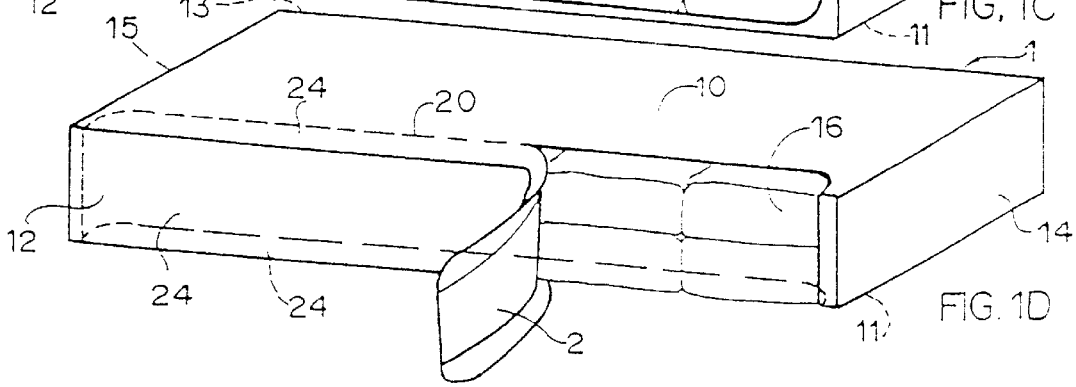

According to the fourth embodiment shown in FIG. 1D, three interconnected surface portions 24 extend over the side face 12 and portions of the top and bottom faces 10, 11.

As is known to one skilled in the art having regard for the disclosure below, the carton of cigarettes 1 is made with the aid of a folded blank where portions of the bottom and end faces 11, 14 and 15 are superimposed and glued in order to close the carton. It is preferable that the end faces do not include opening structure because it would be more difficult to produce pre-cut lines on several superimposed surfaces glued to one another so as to be exactly superimposed.

The fourth embodiment of FIG. 1D can be carried out preferably if only one portion of the bottom face 11 comprises two superimposed sheets, the other portion of that face then being able to receive the pre-cut.

The four embodiments described above are described only by way of example, and the surface portions 21, 22, 23, and 24 may be given other shapes, sizes, and arrangements subject to the limitations mentioned in the preceding paragraph. It is particularly not necessary for one of the portions of the pre-cut line 20 to be in the shape of a partial circle, and it would also be possible to have pre-cut surface portions of polygonal shape, preferably quadrangular. As is the case of one portion of pre-cut line 20 having the shape of a partial circle greater or less than a quarter of a circle or, more generally, a curved shape.

The examples described above show pre-cut surfaces 21, 22, 23, 24 which are closed, i.e., the pre-cut line 20 defines a continuous periphery without any breaks. However, the pre-cut line may be modified to include the whole line 20 shown in FIG. 1A except for the two quarter circular portions and the straight portion near and parallel to the end face 15. This modified embodiment might be applied to all the previously described embodiments.

Figure 2A:
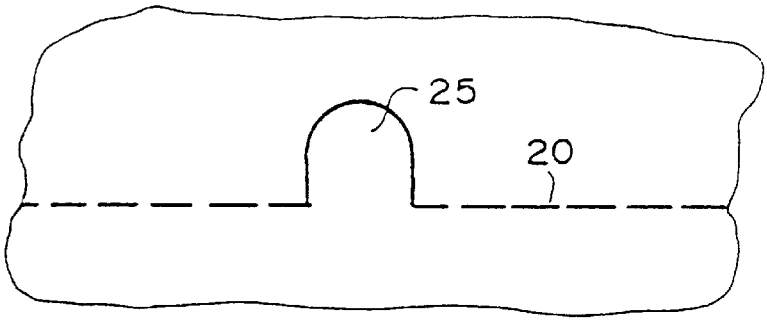

In order to facilitate opening the carton, means for starting the opening may be provided. For example, FIG. 2A shows a starting tab 25 pre-cut along a pre-cut line 20. In FIG. 2A, the pre-cut line 20 is straight, but the tab 25 may also be located on a curved portion of the pre-cut line 20.

Figure 2B:
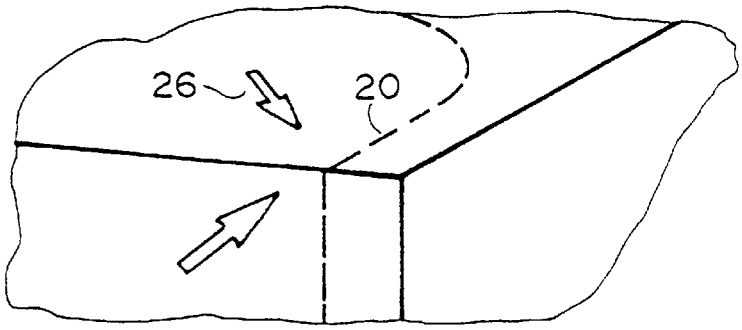
Figure 2C:
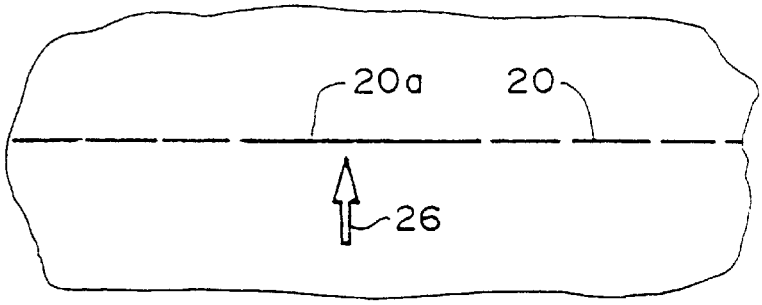
Figure 2D:
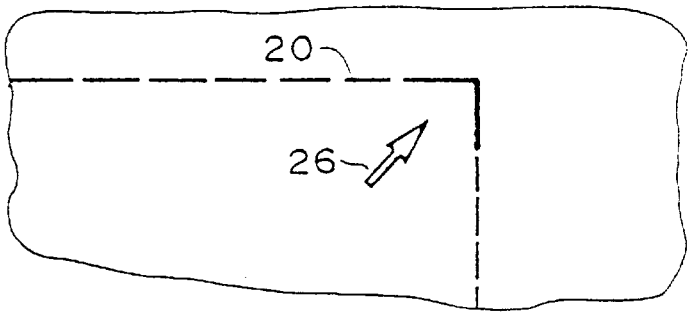

A starting tab 25 according to this embodiment may be used for each of the embodiments described having pre-cut surface portions. According to another embodiment as shown in FIG. 2B, when the pre-cut portions straddle an at least one edge of the carton, the means for starting the opening may consist only of an imprint of one or two pictograms, such as the arrows 26, for example, on one corner of the carton. It is thereby indicated that it suffices to pinch these two surface portions and pull them back in order to open the carton. This embodiment of the means for starting the opening therefore applies only to the last two embodiments of FIGS. 1C and 1D. In FIG. 2C, there is also a pictogram 26 indicating a pre-cut portion 20*a* which is longer than the pre-cut line 20, straight or curved, indicating that by inwardly pressing this portion, e.g. with a fingernail, it is easy to start the opening of the carton. The modification of FIG. 2D applies in the case where the pre-cut line 20 is made of two straight portions forming a corner.

Here the pictogram 26 indicates that it is possible to push this corner in or to lift it for starting the opening of the carton. It is obvious that the pictograms described here in the form of arrows are described only by way of example and that any pictogram or other indication comprehensible to the user may be used. The pictograms are directly printed at the appropriate locations on the web 3 described below. It is therefore seen that the means for starting the opening is different from the prior art cartons in that such means provided by the present invention permits being freed of the necessity of adding a tearing tape or thread to the packaging.

Figure 3:
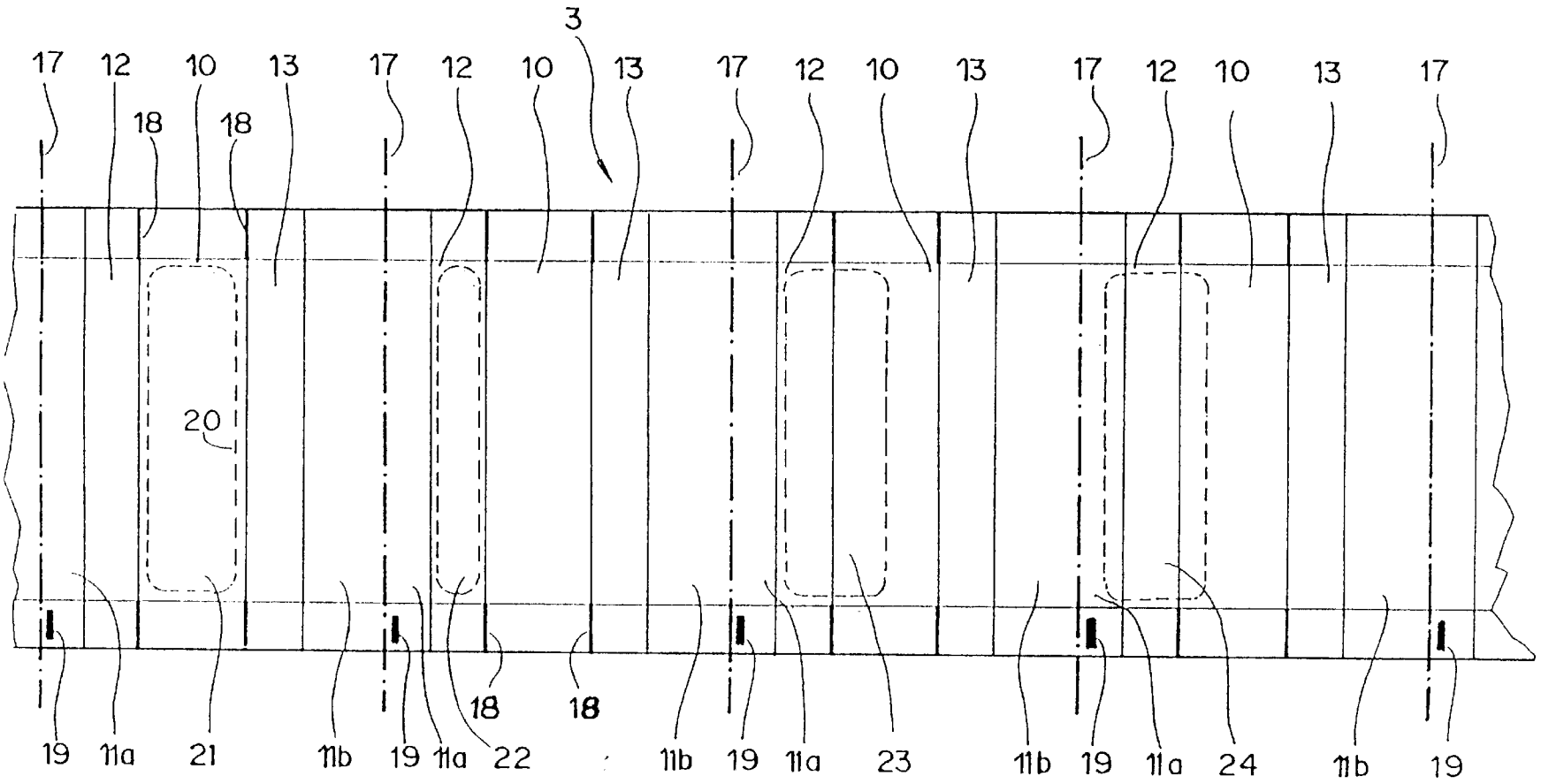
FIG. 3 illustrates an exemplary web portion of the material for making cartons according to the present invention, having the four alternative pre-cuts as shown in FIGS. 1A–D.

The carton 1 of the present invention may be produced from a flexible web 3 as shown in FIG. 3. The web 3 is of paper, metallized paper, synthetic material such as polypropylene (transparent or opaque), or composite material. One face of the web is generally pre-printed with the logo of the brand of cigarettes and/or any other necessary indication or design. This long web 3 is subsequently cut out along the dot-dash lines 17 in order to form the individual blanks which, after folding, form the cartons.

In a preferred embodiment, indicia are printed upon the cut lines to highlight or help to hide them, and provide the consumer with an indication as to where to tear the outer carton.

The fine solid lines represent lines bounding the various faces 10, 11, 12, and 13, as well as the portions forming the end faces of the carton. The cutting line 17 separating each blank is preferably situated in a central region of the bottom face 11, separating the latter into two portions 11*a* and 11*b*, the edge of one of these portions being subsequently superimposed on the edge of the other portion in order to be glued there. For this purpose, it is necessary that the sum of the longitudinal dimensions of the portions 11*a* and 11*b*, in the direction of the longitudinal dimension of the web 3, be slightly greater than the longitudinal dimension of the top face 10.

As is shown, partial cuts 18 may also be made on the web 3 in order the facilitate folding of the end faces.

The web 3 shown in FIG. 3 includes the four embodiments of the opening means previously described. On the carton disposed at the far left, the surface portion 21 almost entirely covers the panel which will later form the top face 10. The next carton comprises a pre-cut surface portion 22 disposed on the side face 12. For the following carton, the pre-cut portions 23 relate to the top and side faces 10 and 12, and for the last carton at the right, the pre-cut portions 24 are disposed on the side and top faces 12 and 10 and on a portion of the bottom surface 11*a* which will not be covered by the portion 11*b*. The portion of web 3 shows the four embodiments of the opening means described above, but it is apparent that as a practical matter, a single embodiment is chosen to be carried out.

The pre-cut lines 20 surrounding each of the pre-cut surfaces according to one or the other of the described embodiments are preferably disposed quite close to one or the other of the folding lines, without ever being directly superimposed thereon. This subsequently permits preventing undesired tearing of the opening means at the time of folding which maintains certain rigidity of the opened carton, and, for certain embodiments, holds the remaining packs within the carton. The pre-cut line is preferably disposed at a distance equal to or greater than 1 mm from the nearest folding line.

Also, web 3 includes locating marks 19, one per carton, precisely disposed at a certain location on each carton, preferably at a location which will subsequently be masked by a fold. These locating marks 19 serve to key the pre-cutting and cutting machine, as described more fully below.

Figure 4:
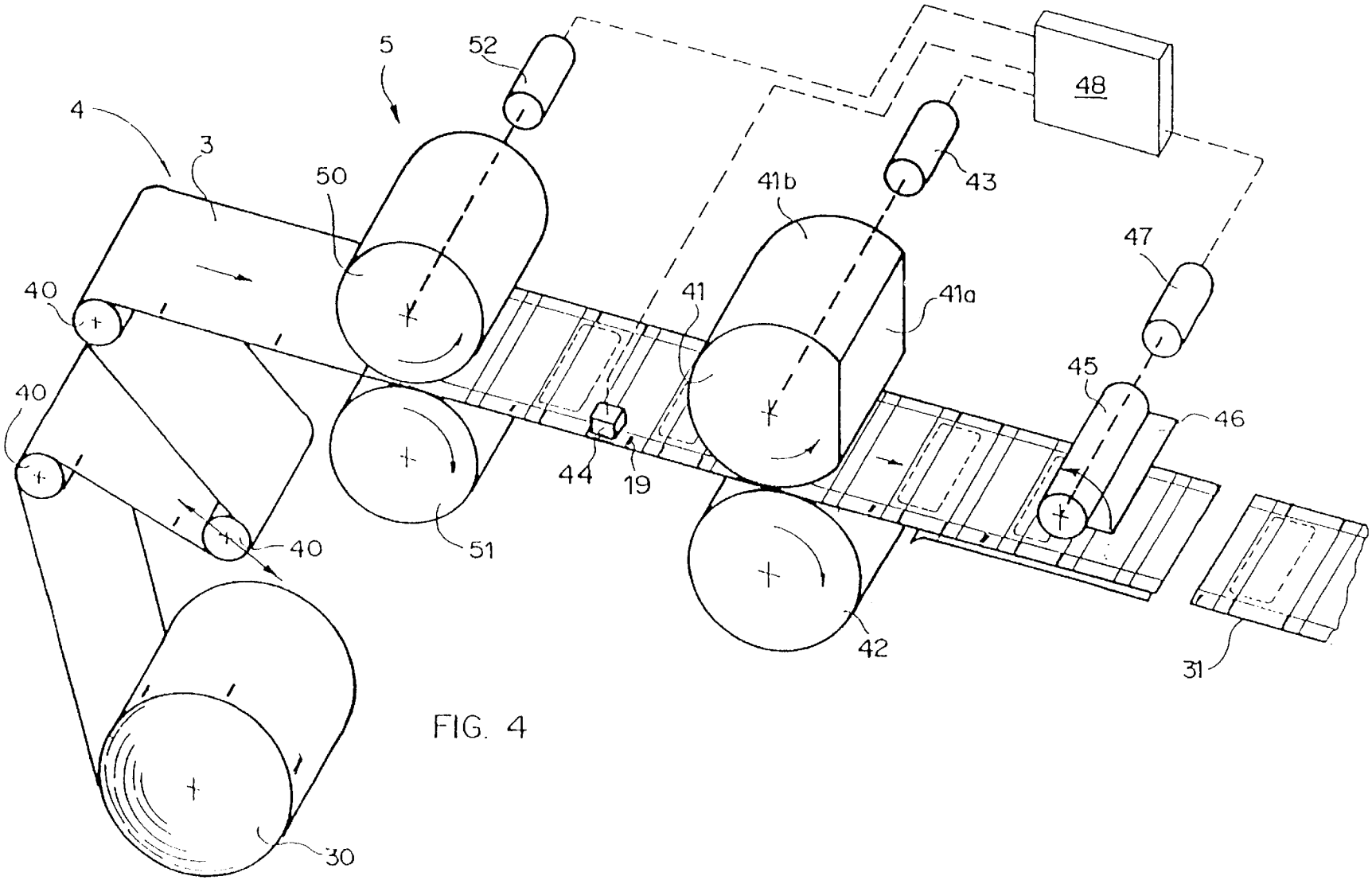
FIG. 4 is a partial diagrammatic view of an exemplary machine for making the carton packaging, according to the present invention.

FIG. 4 diagrammatically illustrates a portion of a machine 4 for preparing the blanks intended to form the cartons of cigarettes. The web 3 is taken from a reel 30 of continuous web material mounted on a rotating shaft. The web then passes through a set of idler rollers 40, at least one of which acts as a tightener. The advance of the web 3 is controlled by a set of rollers 41, 42 which preferably extend over the entire width of the web 3. Each of the rollers is disposed on one face of the web. The roller 41 is rotated by motivator 43, while the roller 42 serves as a counter-roller. Roller 41 has a flat 41*a* on its peripheral surface. Thus, the web 3 is driven when the circular portion 41*b* of the peripheral surface of the roller 41 is in contact with the upper surface of the web 3, whereas the web 3 is stopped when the flat 41*a* faces the web 3.

In order to facilitate driving of the web 3, the surface portion 41*b* of the roller 41 is preferably rubberized.

The pre-cutting portion 5 of the machine 4 is preferably composed of two rollers 50 and 51. Pre-cutting roller 50 is driven by a motivator 52, while the roller 51 serves as a counter-roller. The outside surface of the counter-roller 51 is preferably metallic.

Optionally, the rollers 41 and 42 could be configured in a similar manner as rollers 50 and 51, and be precisely controlled by, e.g. software run through a computer or programmable logic controller, such as an Allen Bradley programmable logic controller. Preferable motors in that case would include variable step motors capable of low speed accuracy.

Figure 5:
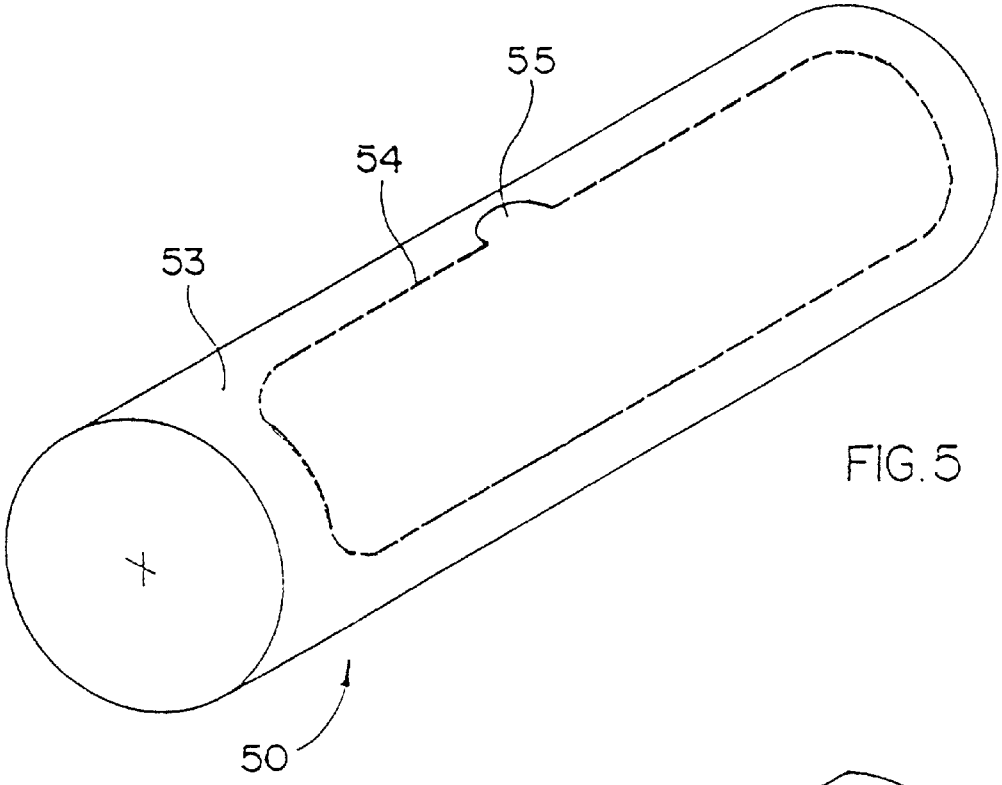
FIG. 5 is a perspective view of an example of a pre-cutting roller, according to the present invention.
Figure 6:
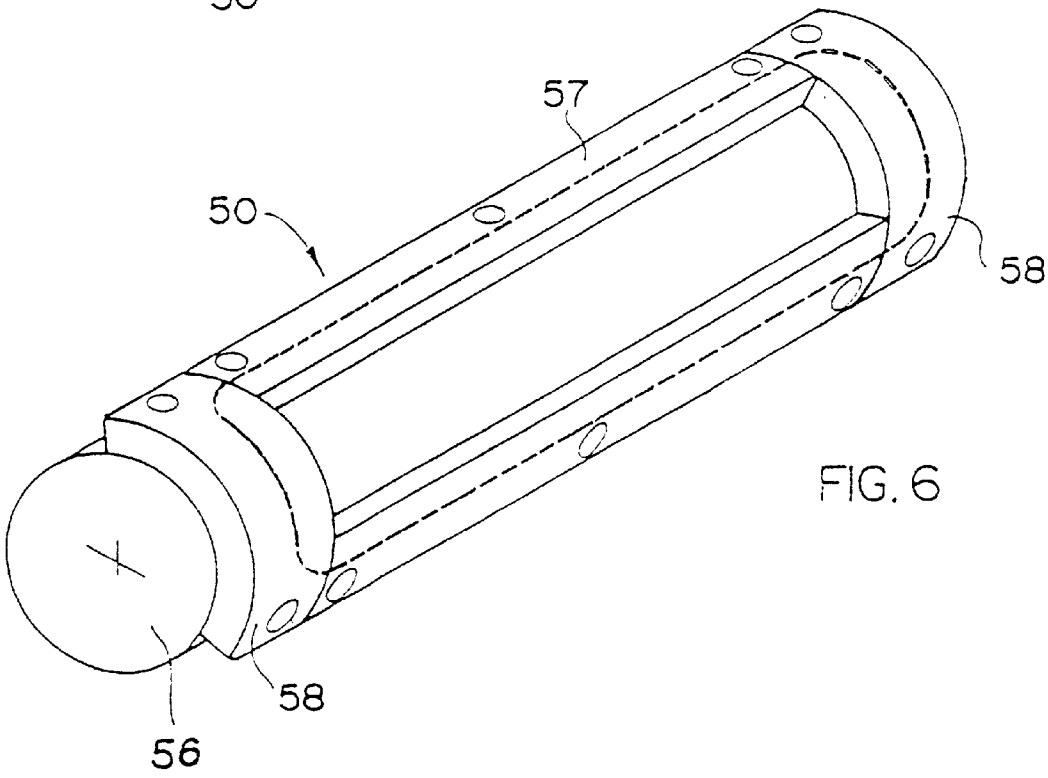
FIG. 6 is a perspective view of another exemplary embodiment of pre-cutting roller, according to the present invention.

Two embodiments of a pre-cutting roller 50 are shown in FIGS. 5 and 6.

The pre-cutting roller 50 shown in FIG. 5 is made of a cylinder having a sharpened projecting pre-cutting line 54 on its outside surface 53 corresponding to the periphery of the pre-cutout surface portions 21, 22, 23, or 24. The cutting edge 54 includes cutting portions alternating with hollow portions, thus creating the pre-cut line 20 made up of pre-cut portions and interconnected attachment portions.

The respective lengths of the pre-cut portions and attachment portions of the pre-cut line 20, or of the cutting portions and hollow portions of the cutting edge 54, are determined according to the needs and according to the resistance of the material making up the web 3. In this way, each pre-cut is not complete, the pre-cut line 20 then corresponding to a line whose mechanical resistance is greatly weakened. This course of action permits the carton to retain a certain fluid-tightness. A cutting portion 55, adjoining the edge 54, is also shown in the FIG. 5, for forming a starter 25 as in FIG. 2A.

FIG. 6 shows another embodiment of a pre-cutting roller 50, made of a roller 56 of smaller diameter than the roller of FIG. 5, and on which straight cutting blades 57 having curved portions 58 are mounted so as to determine a cutting line corresponding to the development of the pre-cut line 20. Cutting blades 57 and 58 are fixed to the roller 56 by fastening structure well known in the art, such as screws or pins, for example.

The advantage of a roller according to this latter embodiment is that it is easily possible to change the shape and/or the size of the pre-cut line 20 by exchanging one or more of the cutting blades. It is also easier to repair such a roller in case of premature wear of a blade or damage to one of these cutting blades. It is also possible to separate the cutting blade 58 into several partial blades, e.g., two blade portions having quarter-circular cutting portions and a straight blade portion. As before, it is possible to add a cutting portion in order to prepare the start of an opening. Likewise, it is also possible for the cutting edges to incompletely pass through the web 3 to greatly weaken it.

The length of the outside perimeter of the roller 50, at the level of the plane of the cutting edges, corresponds to the development of the length of the web 3 between two cutting lines 17 (see FIG. 3).

Returning to FIG. 4, an optical sensor 44 is responsible for detecting the position of the marks 19 on the web 3. Also, a cutting roller 45 is provided with a cutting blade 46, driven by a motivator means 47. A support table ensures the support of the cutting blade 46 at the time of the cutting operation. Instead of a support table, it is also possible to have another counter-roller.

The motivator 52 for the pre-cutting roller 50, motivator 43 for the driving roller 41, and motivator 47 for the cutting roller 45 are controlled by a control unit 48, controlled by a signal transmitted by the optical sensor 44. The control unit 48 is particularly responsible for angularly keying each of the motivators 52, 43, and 47 in such a way that the driving, the pre-cutting, and the cutting are carried out regularly and sequentially on the web 3.

For example, the web 3 is driven by the portion 41*b* of the driving roller 41, the developed length of the portion 41*b* corresponding to the length between two cutting lines 17, while the pre-cutting roller 50 makes the pre-cut according to one or the other of the positions shown in FIG. 3. At the same time, the roller 45 makes the cut with the aid of the blade 46 on a more forward part the web 3.

When this pre-cut and this cut are made, the driving roller 41 arrives at an angular position where the portion 41*a* is facing the web 3, and the web is then no longer being driven. At this moment, the front portion 31 of the web 3 which has just been cut is taken away in order to receive the packs of cigarettes to be packed in cartons. The portion of the machine where the operations of bringing the packs of cigarettes and folding and gluing of the packaging are not shown.

It follows from FIG. 4 that the folding lines of each blank appear on the web 3 after the latter has passed between the rollers 50 and 51. These imaginary lines have been shown here solely in order to make the connection with FIG. 3 and in order to see the positioning of the preweakened lines on the web. The locating marks 19, on the other hand, are preferably already printed on the reeled web.

In those cases where portions of pre-cut lines 18 are to be made in order to assist the folding of the carton, a roller similar to the roller 45, comprising several blades, may be added to the machine in order to carry out this operation.

Instead of having the blanks 31 intended to form each individual packaging in the form of a web, it is also possible to have the blanks already cut to the suitable format and disposed in the form of a stack at the entry to the machine. Known handling structure may be used to permit each successive blank to be seized and sent to a machine portion comprising the pre-cutting roller 50, as well as the counter-roller 51, in order to carry out the same pre-cutting operations described above.

Figure 7:
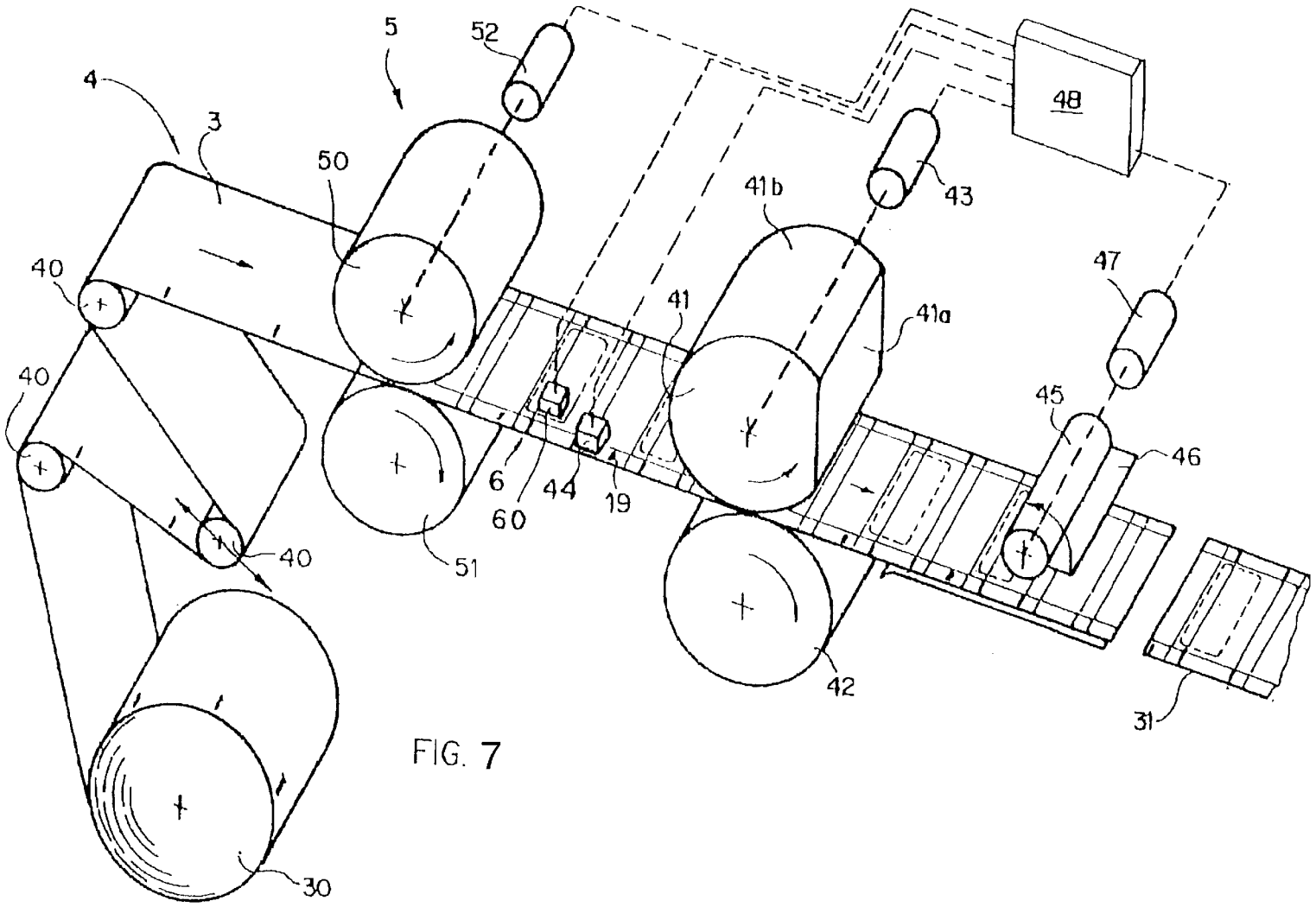
FIG. 7 is a partial diagrammatic view of a machine for making the packaging according to a different embodiment of the invention.

FIG. 7 diagrammatically illustrates a portion of a different embodiment of a machine similar to that illustrated in FIG.

4. Printing device 6 has a printer 60 which deposits an image upon the flexible web as it passes below. The printer is controlled by the control means 48 by means of which the printing and web advance is synchronized so as to place the print in a desired location suitable for, e.g. opening indicia or concealment of opening score lines. The optical sensor signals the control unit with a location signal useful for coordinating the various activities of the machine, e.g. printing, advancing, and cutting the web.

The printer may be an ink-jet, laser jet, physical, thermal, or other means of depositing the image. Instead of a printer, the apparatus may also be configured to deposit pressure sensitive labels overlapping the score line in such a manner as to ease the opening of the packet. For example, if the pressure sensitive label is not completely covered on the attachment face with the adhesive, a loose end may be produced, which loose end is securely fastened to the scored portion by the fixed end. The loose end may be grasped easily and pulled, thereby facilitating removal of the scored portion by means of its attachment to the other end of the label.

Figure 8:
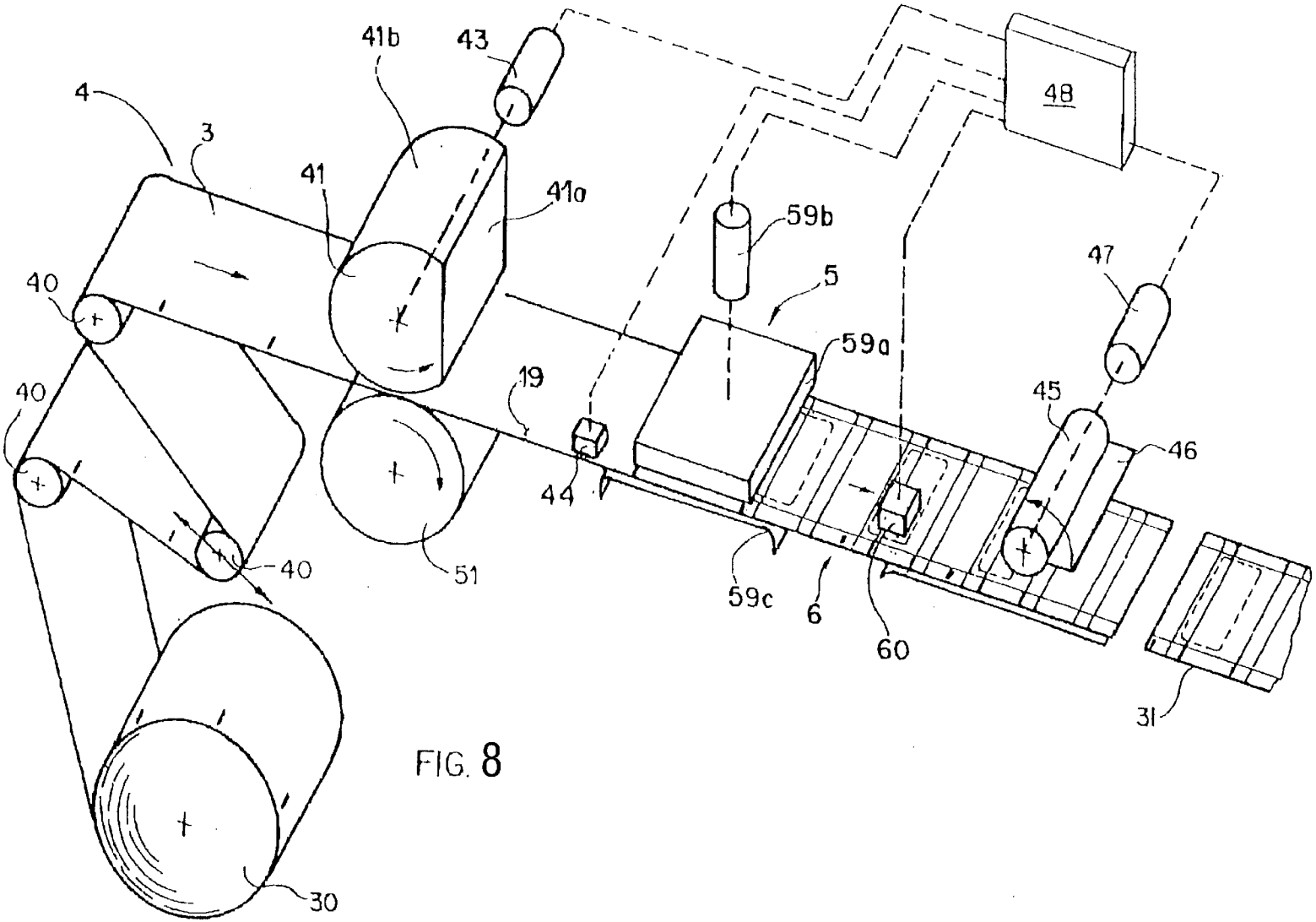
FIG. 8 is a partial diagrammatic view of a machine for making the packaging according to a different embodiment of the invention.

Turning now to FIG. 8, a different embodiment of the apparatus is visible. The scoring device 5 is a linearly driven cutter 59*a* which has a pattern of raised sharpened edges on its face similar to that seen in FIGS. 5 and 6, except flat.

The scoring device is driven downwardly into the web by actuator 59*b;* and presses the web between itself and support 59*c*. The actuator is preferably a solenoid, pneumatic or hydraulic jack.

In this embodiment of the apparatus, the printer head is disposed downstream of the flat cutter and upstream of the separating cutter 45. The printing and cutting actions can be synchronized to occur during the stop period when the flat portion 41*a* of the roller causes the web to pause.

Suction rollers can also be used throughout an apparatus according to the present invention; polypropylene wrap (a preferred embodiment) is frequently charged with static electricity and is more easily handled under the action of suction.

The preceding description relates to a carton of cigarettes comprising 10 packs disposed in two superimposed rows of five packs. It is obvious that it may apply to all sorts of cartons containing some other number of packs and/or packs disposed differently. It also applies more generally to packaging of a similar type, especially packaging grouping a number of objects, particularly objects already packaged individually. It is thus possible to reach one object after the other in a wrapped bundle containing a plurality of stacked objects. In view of its functionality, permitting the objects it contains to be taken one by one, such a packaging may also be directly used to distribute these objects.

What is claimed is:

1. A process of preparing an opening structure on a packaging blank which permits easy access to rigid objects contained in the packaging blank when wrapped around the rigid objects, comprising the steps of:

providing a sheet of paper or polypropylene material as the packaging blank, said sheet having periodic markings thereupon;

producing a line of weakened resistance at the opening structure by means of a pre-cutting device synchronized with the periodic markings upon the sheet.

2. A process according to claim 1 wherein the sheet is a continuous sheet, the process further comprising a step, subsequent to the step of producing the line of weakened resistance, of cutting the sheet into discrete packaging blanks.

3. A process according to claim 1, wherein the sheet is a discrete packaging blank, the process further comprising removing one of the packaging blanks from a stack and feeding the packaging blank to the pre-cutting device.

4. A process according to claim 1, wherein the step of producing the line of weakened resistance is carried out on a machine comprising means for feeding and driving the sheet constituting the packaging blank.

5. A process according to claim 1 wherein the step of producing the line of weakened resistance is carried out by pressure of a pre-cutting roller against the sheet constituting the packaging blank when the sheet is driven in a longitudinal direction.

6. A process according to claim 5 wherein the line of weakened resistance is position adjustable over the length of the packaging blank by means of a detector cell detecting the position of a mark printed on the packaging blank and acting upon angular keying of driving means for the pre-cutting roller via a control unit.

7. A process according to claim 1, wherein the step of producing the line of weakened resistance is carried out by pressure of a pre-cutting die against the sheet constituting the packaging blank when the sheet is not being driven in a longitudinal direction.

8. A process according to claim 1, further comprising a step of printing indicia on the sheet adjacent the line of weakened resistance.

9. A process according to claim 1, wherein the sheet is a film is polypropylene.

10. A process according to claim 1, further comprising folding the sheet into a carton having two end faces and four side faces, the opening structure being entirely within one of the side faces.

11. A process according to claim 1, further comprising folding the sheet into a carton having two end faces and four side faces, the opening structure being entirely within two of the side faces, the line of weakened resistance passing across a side edge of the carton at two locations adjacent the end faces of the carton.

12. A process according to claim 1, further comprising folding the sheet into a carton having two end faces and four side faces, the opening structure being entirely within three of the side faces, the line of weakened resistance passing across two side edges of the carton at four locations adjacent the end faces of the carton.

13. A process according to claim 1, further comprising folding the sheet into a carton having two end faces and four side faces, the opening structure permitting individual access to each of ten packs of cigarettes contained in the carton.

14. An apparatus for preparing an opening structure on a carton, said carton being formed from a sheet of paper or polypropylene material, comprising:

a means for periodically advancing the sheet, a pre-cutting die actuable during a period of time when the sheet is not moving, said die pressing on the sheet to form a line having weakened resistance to tearing thereupon, the pre-cutting die being driven by a first actuator and the means for periodically advancing the sheet being driven by a second actuator, the first and second actuators being controlled independently of each other by a controller.

15. An apparatus according to claim 14, further comprising means for folding the sheet into a carbon having two end faces and four side faces, the opening structure being entirely within one of the side faces.

16. An apparatus according to claim 14, further comprising a printing device which prints an image upon the sheet.

17. An apparatus according to claim 16, wherein the printing device is configured to print indicia in close proximity to the line of weakened resistance.

18. An apparatus according wherein claim 14 wherein the pre-cutting die has at least one cutting BLADE with a cutting edge in the shape of an arc.

19. An apparatus according to claim 14 wherein the line of weakened resistance surrounds an area of the sheet on at least one face of the carton.

20. An apparatus according to claim 14 wherein the line of weakened resistance further includes a portion for cutting a starting portion to facilitate opening the carton.

21. An apparatus according to claim 14, wherein the pre-cutting die cooperates with a support surface such that the sheet is pressed between the pre-cutting die and the support surface.

22. An apparatus according to claim 14 wherein the controller receives an input from a detector cell detecting a mark printed on the sheet and the controller synchronizes actuation of the pre-cutting die with detection of the mark by the detector cell.

23. An apparatus according to claim 14, further comprising a means for attaching an adhesive label to the opening structure.

24. An apparatus according to claim 14, further comprising means for folding the sheet into a carton having two end faces and four side faces, the opening structure being entirely within two of the side faces, the line of weakened resistance passing across a side edge of the carton at two locations adjacent the end faces of the carton.

25. An apparatus according to claim 14, further comprising means for folding the sheet into a carton having two end faces and four side faces, the opening structure being entirely within three of the side faces, the line of weakened resistance passing across two side edges of the carton at four locations adjacent the end faces of the carton.

26. An apparatus according to claim 14, further comprising means for folding the sheet into a carton having two end faces and four side faces, the opening structure permitting individual access to each of ten packs of cigarettes contained in the carton.

27. A device for preparing an opening structure on a carton formed from a sheet of paper or polypropylene material, the device comprising:

a transport device for moving the sheet in a longitudinal direction;

a sensing device comprising at least one sensor for sensing a periodic marking on the sheet;

a pre-cutting device pressing an opening structure on the sheet, said pre-cutting device and transport device being controlled by a controller in response to the sensing device, the pre-cutting device being driven by a first actuator and the transport device being driven by a second actuator, the first and second actuators being controlled independently of each other by the controller.

28. A device according to claim 27 wherein the pre-cutting device comprises a roller having a cylindrical outside surface with cutting portions to produce a line of weakened resistance on the sheet while the sheet is being transported in a longitudinal direction.

29. A device according to claim 27 wherein the pre-cutting device comprises a die having a flat surface with cutting portions to produce a line of weakened resistance on the sheet while the sheet is not being transported in a longitudinal direction.

30. A device according to claim 27 wherein the pre-cutter includes a portion for cutting a starting portion to facilitate opening the carton.

31. A device according to claim 27 wherein the sheet is continuous, and the device further comprises at least one cutting roller for cutting the sheet into a series of separate packaging blanks.

32. A device according to claim 27, further comprising means for folding the sheet into a carton having two end faces and four side faces, the opening structure being entirely within one of the side faces.

33. A device according to claim 27, further comprising means for folding the sheet into a carton having two end faces and four side faces, the opening structure being entirely within three of the side faces, the line of weakened resistance passing across two side edges of the carton at four locations adjacent the end faces of the carton.

34. A device according to claim 27, further comprising means for folding the sheet into a carton having two end faces and four side faces, the opening structure permitting individual access to each of ten packs of cigarettes contained in the carton.

35. A device according to claim 27, further comprising means for folding the sheet into a carton having two end faces and four side faces, the opening structure being entirely within two of the side faces, the line of weakened resistance passing across a side edge of the carton at two locations adjacent the end faces of the carton.

* * * * *